US007186022B2

(12) United States Patent
Charles, Jr. et al.

(10) Patent No.: US 7,186,022 B2
(45) Date of Patent: Mar. 6, 2007

(54) X-RAY SOURCE AND METHOD FOR MORE EFFICIENTLY PRODUCING SELECTABLE X-RAY FREQUENCIES

(75) Inventors: Harry K. Charles, Jr., Laurel, MD (US); Thomas J. Beck, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 78 days.

(21) Appl. No.: 10/467,944

(22) PCT Filed: Jan. 30, 2003

(86) PCT No.: PCT/US03/02590

§ 371 (c)(1),
(2), (4) Date: Aug. 14, 2003

(87) PCT Pub. No.: WO03/065772

PCT Pub. Date: Aug. 7, 2003

(65) Prior Publication Data

US 2004/0076260 A1 Apr. 22, 2004

Related U.S. Application Data

(60) Provisional application No. 60/353,742, filed on Jan. 31, 2002.

(51) Int. Cl.
*H01J 35/10* (2006.01)
*H01J 35/12* (2006.01)

(52) U.S. Cl. ..... 378/200; 378/199

(58) Field of Classification Search ..... 378/119–124, 378/130, 137, 138, 141, 143
See application file for complete search history.

(56) References Cited

U.S. PATENT DOCUMENTS

| | | | |
|---|---|---|---|
| 2,222,549 | A | 11/1940 | Verhoeff |
| 3,482,096 | A | 12/1969 | Lewis et al. |
| 3,546,511 | A | 12/1970 | Shimula |
| 3,983,397 | A | 9/1976 | Albert |
| 4,007,375 | A | 2/1977 | Albert |
| 4,034,251 | A | 7/1977 | Haas |
| 4,048,496 | A | 9/1977 | Albert |

(Continued)

FOREIGN PATENT DOCUMENTS

EP 0432568 A2 * 6/1991

(Continued)

*Primary Examiner*—Edward J. Glick
*Assistant Examiner*—Irakli Kiknadze
(74) *Attorney, Agent, or Firm*—Francis A. Cooch

(57) ABSTRACT

An x-ray tube and method of operating include a vacuum chamber vessel and a source of an electron beam inside the vacuum chamber vessel. A target disposed inside the vacuum chamber vessel includes a substrate and one or more deposits attached to the substrate. Each different deposit includes an atomic element having a different atomic number. The x-ray tube also includes a means for directing the electron beam to a selectable deposit of multiple deposits. The substrate material can be selected with better vacuum sustaining strength, x-ray transparency, melting point, and thermal conductivity than a deposit. The substrate may be cooled by an integrated cooling system. The x-ray tube allows a selectable x-ray frequency to be produced with enhanced economy of power, reduced moving parts, and reduced size. For improved bone mass applications, one of the deposits has a k-fluorescence energy less than about 53 thousand electron volts.

3 Claims, 5 Drawing Sheets

U.S. PATENT DOCUMENTS

| | | | | |
|---|---|---|---|---|
| 4,352,392 | A * | 10/1982 | Eastman | 165/104.25 |
| 4,768,212 | A | 8/1988 | Appelt et al. | |
| 4,928,296 | A | 5/1990 | Kadambi | |
| 4,958,363 | A | 9/1990 | Nelson et al. | |
| 4,969,175 | A | 11/1990 | Nelson et al. | |
| 5,742,660 | A | 4/1998 | Majewski et al. | |
| 5,757,885 | A | 5/1998 | Yao et al. | |
| 5,859,893 | A | 1/1999 | Moorman et al. | |
| 6,118,853 | A | 9/2000 | Hansen et al. | |
| 6,154,521 | A * | 11/2000 | Campbell | 378/125 |
| 6,282,263 | B1 | 8/2001 | Arndt et al. | |
| 6,307,916 | B1 | 10/2001 | Rogers et al. | |
| 6,366,642 | B1 * | 4/2002 | Andrews | 378/130 |
| 6,377,659 | B1 * | 4/2002 | Snyder et al. | 378/142 |
| 6,377,660 | B1 * | 4/2002 | Ukita et al. | 378/143 |
| 6,487,273 | B1 * | 11/2002 | Takenaka et al. | 378/142 |
| 6,490,340 | B1 * | 12/2002 | Artig et al. | 378/121 |
| 6,519,317 | B2 * | 2/2003 | Richardson et al. | 378/130 |
| 6,553,096 | B1 * | 4/2003 | Zhou et al. | 378/122 |
| 6,850,598 | B1 * | 2/2005 | Fryda et al. | 378/161 |
| 2001/0001010 | A1 * | 5/2001 | Wilkins | 378/43 |
| 2002/0101958 | A1 | 8/2002 | Bertsche | |

FOREIGN PATENT DOCUMENTS

| | | |
|---|---|---|
| EP | 0567183 | 4/1993 |
| FR | 708594 | 7/1931 |
| GB | 240166 | 3/1926 |
| GB | 776208 | 6/1957 |
| WO | WO 99/50882 | 10/1999 |

* cited by examiner

X-RAY SOURCE AND METHOD FOR MORE EFFICIENTLY PRODUCING SELECTABLE X-RAY FREQUENCIES

CROSS-REFERENCE TO RELATED APPLICATIONS

This application claims benefit of Provisional Appln. 60/353,742 filed Jan. 31, 2002, the entire contents of which is hereby incorporated by reference as if fully set forth herein, under 35 U.S.C. §119(e).

BACKGROUND OF THE INVENTION

1. Field of the Invention

The present invention relates to an x-ray source; and, in particular to an efficient x-ray source for dual-energy x-ray absorptiometry for measuring tissue properties.

2. Description of the Related Art

The past approaches described in this section could be pursued, but are not necessarily approaches that have been previously conceived or pursued. Therefore, unless otherwise indicated herein, the approaches described in this section are not to be considered prior art to the claims in this application merely due to the presence of these approaches in this background section.

Experience with bed rest subjects, astronauts and cosmonauts indicates that the magnitudes and patterns of bone tissue loss are extremely variable from one individual to the next, and also between different body regions. Little mass appears to be lost from the upper extremities during weightlessness; whereas the rate of mass loss from the vertebrae, pelvis, and proximal femurs of astronauts average between 1 percent and 1.6 percent per month. The rate of mass loss from those sites in postmenopausal woman average between 0.8 percent and 1.3 percent per year—a substantially lower rate of loss.

During space flight, loading is practically absent on the lower skeleton. Not only does bone loss accelerate under diminishing loading, but evidence from cosmonaut data suggests that compensatory distribution changes that increase bone strength are absent as well. This means that astronauts may be at a greater risk of fracture for the same loss of bone mass. Therefore it is important not only to determine bone mass, but also to determine the geometrical configuration of the bone structure. Bones loss countermeasures can be developed to increase the loading on the lower skeleton. The efficacy of such countermeasures is better determined individually, based on the geometrical configuration of the individual's bone structure before and after the countermeasures, than by analyzing bone breakage statistics over a large population of astronauts. There is simply not a large population of astronauts.

Furthermore, the determination of bone structure is useful for screening a population and monitoring treatments of osteoporosis in postmenopausal women, elderly men and other susceptible individuals.

Loading and bone loss countermeasures can also be assessed through the measurements of muscle mass and muscle size in a living human. Therefore it an advantage for a scanning device to also distinguish fat from muscle in soft tissue. Soft tissue excludes bone tissue.

There are several methods for determining bone mineral density (BMD), bone structure, and soft tissue components. These methods include computed tomography (CT), magnetic resonance imaging (MRI), ultrasound, and dual-energy x-ray absorptiometry (DXA).

While a CT unit can image and measure the geometrical characteristics of bone and soft tissue, it is not well suited for use in space because of its high radiation dose per scan. In addition, a CT unit capable of performing total body scans is extremely massive, weighing thousands of pounds. This great weight renders such units impractical for portable and space flight use. In addition, the high cost and large size place such units beyond the reach of small earthbound clinics, which might otherwise administer osteoporosis screening and treatment monitoring. An MRI unit is excellent for imaging soft tissues, for example to distinguish fat from muscle. However, an MRI unit suffers from a similar size and weight disadvantage. An MRI unit capable of performing whole body scans consumes significant power, generates large magnetic fields, and weighs tens of thousands of pounds.

Commercial scanners use dual-energy x-ray absorptiometry (DXA) or ultrasound to yield measurements of bone mineral density (BMD) that are regional averages. However, regional averages obscure structural details, and thus are not precise enough to deduce bone strength. Such systems do not predict risk of breakage. Furthermore, ultrasound devices have not been used successfully for the quantification of muscle mass.

A disadvantage of commercial DXA devices is that they consume a large amount of energy, too much for portable use. Much of the energy consumed is used to generate x-rays at frequencies that are not used. Therefore the excess x-ray frequencies are excised from the x-ray beam using one or more of several filters. Each filter blocks a different portion of the generated spectrum of x-ray frequencies and thus passes a selectable one of several useful x-ray frequencies for tissue analysis.

In addition, the use of several filters and a mechanism to move selected filters into and out of the x-ray beam increases the complexity, the size and the weight of the x-ray source. The increased complexity reduces the reliability of the x-ray source. The increased size and weight makes the source less suitable for a portable and space-borne system.

Another disadvantage of commercial DXA devices is that, even with filters, the resulting x-ray frequency bands are often broader than needed for a particular application. Therefore the radiation dose to a patient for a given signal to noise ratio (SNR) might be excessive.

Based on the foregoing description, there is a clear need for x-ray sources for efficiently producing multiple x-ray frequencies that do not produce excess x-ray frequencies or require several moveable filters.

SUMMARY OF THE INVENTION

In one aspect of the invention, an x-ray source includes an x-ray tube that produces a narrow band of selected x-ray frequencies of multiple selectable x-ray frequency bands and that does not include any moving part In another aspect of the invention, an x-ray tube includes a vacuum chamber vessel, and a source of an electron beam and a target inside the vacuum chamber vessel. The target includes a substrate and multiple selectable deposits attached to the substrate. Each different deposit includes an atomic element having a different atomic number. The tube also includes a source of an electric field for directing the electron beam to a selected deposit of the multiple deposits.

In another aspect of the invention, an x-ray tube includes a vacuum chamber vessel, and a source of an electron beam and a target inside the vacuum chamber vessel. The target includes a substrate and multiple selectable deposits attached to the substrate. The x-ray tube includes a means for directing the electron beam to a selected deposit of the multiple selectable deposits. Each different deposit includes an atomic element that has a different K-shell fluorescence energy. A first deposit includes a first element that has a K-shell fluorescence energy less than about 50 thousand electron volts.

In an embodiment of this aspect, a second deposit includes a second element that has a K-shell fluorescence energy greater than about 100 thousand electron volts.

In another aspect of the invention, an x-ray tube includes a vacuum chamber vessel, and a source of an electron beam and a target inside the vacuum chamber vessel. The target includes a substrate and a deposit different from the substrate attached to the substrate. The electron beam is directed to the deposit to produce x-rays. The substrate has a thermal conductivity many times greater than a thermal conductivity of the deposit.

In an embodiment of this aspect, the substrate forms one portion of the vacuum chamber vessel, has strength to withstand a vacuum, and is transparent to x-rays produced in the deposit.

In another aspect of the invention, an x-ray source includes an x-ray tube and a cooling system. The cooling system includes a fluid vessel for containing a heat-exchange fluid outside the x-ray tube. The fluid vessel includes a spray nozzle that directs the heat-exchange fluid to an outside face of a target of the x-ray tube for absorbing heat generated within the target. The cooling system includes a pump for forcing the heat-exchange fluid through the spray nozzle.

In an embodiment of this aspect, the x-ray tube includes a vacuum chamber vessel and a target that includes a substrate that forms one portion of the vacuum chamber vessel. The substrate has strength to withstand a vacuum. The spray nozzle directs the heat-exchange fluid to an outside face of the substrate. In another embodiment, the target includes a deposit on the substrate; the substrate is transparent to x-rays produced in the deposit when the deposit is struck with an electron beam; and the substrate has a thermal conductivity that is greater than a thermal conductivity of the deposit.

In another embodiment of this aspect, the x-ray tube and the cooling system form a compact integrated unit that weighs less than about twenty pounds.

In an embodiment of this aspect, fins rotated by the pump are disposed outside a fin tube. In another embodiment, a power cable for the x-ray tube is passed inside the fin tube.

In another aspect of the invention, techniques for producing a selected x-ray frequency includes controlling an electron beam source in an x-ray tube to produce an electron beam with electron energy corresponding to the selected x-ray frequency. An electric field source is also controlled to produce an electric field to direct the electron beam onto a selected deposit and away from a different deposit of multiple deposits on a target substrate in the x-ray tube. Each deposit includes an atomic element with a K-shell fluorescence energy that corresponds to one frequency band of multiple selectable x-ray frequency bands. The selected deposit includes an atomic element with a K-shell fluorescence energy that corresponds to the selected x-ray frequency band.

In one aspect of the invention, an x-ray source includes an x-ray tube and a cooling system. The x-ray tube includes a vacuum chamber vessel, and a source of an electron beam and a target inside the vacuum chamber vessel. The target includes a substrate that forms one portion of the vacuum chamber vessel. The substrate has strength to withstand a vacuum in the vacuum chamber vessel and is transparent to x-rays produced by the x-ray tube. Multiple deposits are attached to the substrate. Each different deposit includes an atomic element having a different atomic number. The x-ray tube includes a source of an electric field for directing the electron beam to a selected deposit. The deposits include a first deposit that includes a first element having an atomic number between about 64 and about 74 and a second deposit that includes a second element having an atomic number between about 87 and about 92. The substrate is composed of at least one of polycrystalline diamond, silicon, and sapphire. There is no moving mechanical part inside the x-ray tube. There is no movable x-ray filter to block a portion of an x-ray spectrum generated at the target. The cooling system includes a fluid vessel for containing a heat-exchange fluid outside the x-ray tube. The fluid vessel includes a spray nozzle directing a liquid phase of the heat-exchange fluid to an outside face of the substrate for absorbing heat generated at the target. A heat exchanger portion of the fluid vessel directs heat from the heat-exchange fluid inside the fluid vessel to an ambient fluid outside the fluid vessel. A computer controlled pump forces the liquid phase of the heat-exchange fluid through the spray nozzle at a variable rate sufficient for cooling the x-ray tube. The x-ray tube and the cooling system form a compact integrated unit that weighs less than about twenty pounds.

Techniques using one or more of these aspects allow a selectable x-ray frequency to be produced with enhanced economy of power, or reduced moving parts, or reduced size, or some combination of these properties.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
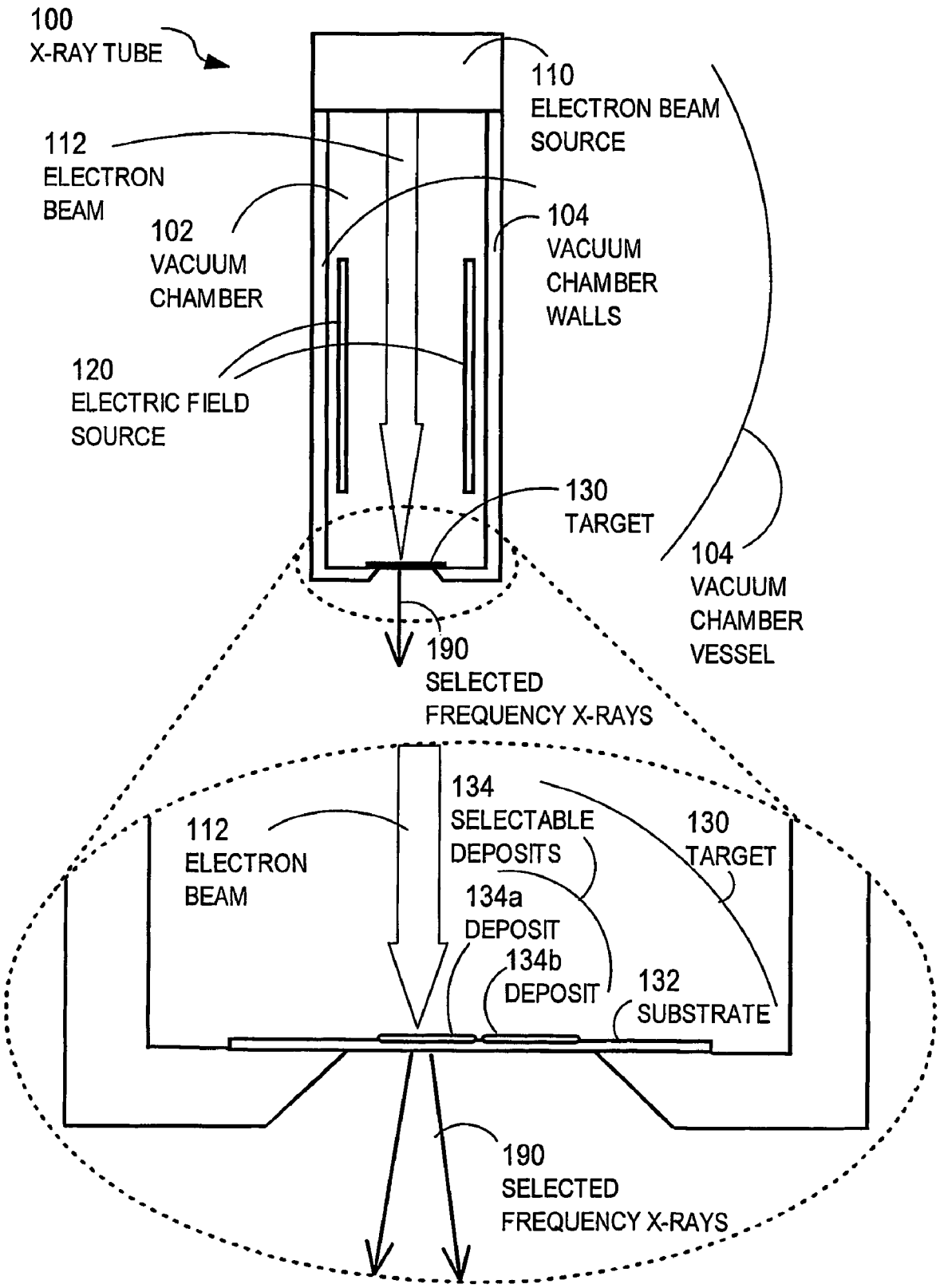
FIG. 1 is a block diagram that illustrates an x-ray tube with a selectable x-ray frequency, according to an embodiment.

A method and apparatus for an x-ray source are described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Embodiments of the invention are described in the context of a dual-frequency x-ray source for use in a dual-energy x-ray absorptiometry (DXA) to yield measurements of bone mineral density (BMD). In particular, embodiments of an x-ray source are described for an advanced, multiple-projection, dual-energy x-ray absorptiometry (AMPDXA) scanning system. However, embodiments of the invention are not limited to this context. Other embodiments may be practiced to produce one or more selectable x-ray frequencies efficiently, with less wasted power, fewer wasted x-ray frequencies, fewer moving parts, or smaller in size than conventional x-ray source, or some combination of these features, for other applications. For example, a manufacturer can mass produce one model of an x-ray tube with multiple deposits on a target for multiple applications, and then configure a chip or computer to select a subset of one or more deposits that are suitable for a particular application for which a particular device is sold. Such applications may include, for example, x-ray sources for the diagnosis and therapeutic treatment of one or more types of cancer.

1. Conventional Dual-Energy X-Ray Tubes

X-rays are electromagnetic waves. A discrete quantum of an electromagnetic wave is a photon. An x-ray with frequency (v) has a photon energy (E) proportional by Plank's constant h; that is, E=h v.

In a conventional x-ray tube, high-energy electrons from a heated filament collide with a target where the electrons are suddenly decelerated to produce x-rays with a distribution (relative number of photons) per photon energy (frequency) determined by the energy of the incident electrons and the material in the target. To avoid excessive collisions with air molecules, the electron beam is enclosed in a vacuum chamber.

A high voltage (V) input, V1, applied between the heated filament and an anode accelerates each electron before the electron slams into the target. In many embodiments, the target is the anode; in some embodiments the target is beyond a wire grid that serves as the anode. The kinetic energy of a single electron accelerated by a 1-volt electric field is an electron volt (about $1.6\times10^{-19}$ Joules, or $4.45\times10^{-24}$ kilowatt-hours). To produce x-rays, the voltage V1 is many tens of thousands of volts. The x-ray tube produces x-ray photons with a distribution of photon energies (a frequency spectrum) up to a cutoff photon energy (cutoff frequency) determined by the input voltage V1; that is, all x-ray photons have energies less than or equal to a cutoff energy of V1 electron-volts (at cutoff frequency vc). The peak energy (at frequency vp) is the x-ray photon energy that has the most photons; the peak energy is slightly less than V1 electron-volts. The number of photons produced decreases with decreasing photon energy (frequency) below the peak energy (frequency vp). To make clear the difference between the energy of x-ray photons and other energies discussed, such as the energy of an electron in an electron beam and the energy flux for a given number of photons, the energy of x-ray photons are described in terms of their frequencies.

An x-ray power supply provides the high voltage input, V1, between the heated filament and the anode. The x-ray power supply also provides enough electrons per second, current (I), to supply a useful number of electrons striking the target. An Ampere of current is 1 coulomb per second, which is about $0.6\times10^{19}$ electrons per second. The power provided by the power supply is the product of the current I and the voltage V1. By definition, the unit of the product, an Ampere-volt, is a Joule per second, which by definition is 1 Watt.

In a dual-energy system (i.e., a dual-frequency system), the power supply also drives the x-ray tube at a different voltage V2, which causes a different distribution of x-ray energies (frequency spectrum) with a different cutoff energy (at a second cutoff frequency vc2) and a different peak energy (at a second peak frequency vp2). To distinguish among multiple x-ray spectra, each different x-ray spectrum is associated with a different peak frequency.

A conventional x-ray source often includes a filter for limiting the distribution of frequencies about the peak frequency. In a dual-energy system, two different filters are often employed, and a mechanism is included to move one filter into position and the other filter out of position to intercept the x-rays output by the x-ray tube. The filter is made of a material that blocks the lower energy x-rays, below the peak energy, passing only x-rays with energies above a high-pass energy (at frequency va). As a result, only a narrow range of x-ray photon energies, from a high pass energy (at va) just below the peak energy (at vp) to the cutoff energy (at vc), emerges from an x-ray source assembly. In a dual-energy system, a second filter is used when the power supply drives the x-ray tube at the second voltage V2. The second filter blocks x-ray photon energies below a second high pass energy (at va2), which is less than the second peak energy (at vp2).

As described in the background section, conventional x-ray sources suffer from consuming excess power to generate excess x-rays at frequencies that are not used and that are removed by a filter.

2. K-shell Fluorescence

According to embodiments of the invention, a narrow band of x-ray frequencies at a selected frequency that is optimal for a given application is produced using K-shell fluorescence. With such a source, electron beam power is efficiently transferred only to x-rays in a useful narrow frequency spectrum so that wasted power and excess radiation are avoided and burdensome filters can be omitted.

In K-shell fluorescence, an electron in a so-called "K-shell" of an atom of material in the target is energized by a collision with an electron in the electron beam. If the electron in the electron beam is energetic enough, the electron in the K-shell is energized sufficiently to reach the next higher shell of the atom (the so called "L-shell") or to escape the atom entirely. The energy that causes a K-shell electron to just escape its atom is the K-shell binding energy. The energized electron is then recaptured by a net positively charged atom of the material with a vacant position on its K-shell. The recaptured electron releases a photon with photon energy equal to the energy given up to return to the K-shell, about the K-shell binding energy. If the atomic number, Z, of the atom in the material is great enough, the photon energy (frequency) is in the range of x-ray photon energies (frequencies). In typical x-ray tubes, the target is Tungsten (symbol W, Z=74).

It is well known that a material is relatively transparent to its K-shell fluorescence. Therefore most of the x-rays produced by K-shell fluorescence are not reabsorbed by the material in the target but escape the x-ray tube. This leads to a very efficient transfer of energy from the electrons in the electron beam to the x-ray photons that are emitted by the target if the electron beam has electrons with energy near the K-shell binding energy and near the transition energy to the L-shell.

Furthermore, if the electrons in the electron beam have energies that exceed the K-shell binding energy, the generated photons will be readily re-absorbed in the target material. The absorbed photons energize electrons in the K-shell, cause them to escape and to release more x-rays when they are re-captured. Such emission near the edge of the material will escape the target and add to the total x-ray emission from the target at slightly higher frequencies.

As a result, K-shell fluorescence can produce a relatively narrow x-ray spectrum (i.e., a spectrum in a narrow band of frequencies) that efficiently transfers energy to the x-rays from an electron beam with energy matched to the K-shell binding energy.

While a material can usually be found that has a K-shell fluorescence spectrum that is optimal for a particular application, the material may not be suitable for a target of an x-ray tube for a variety of other reasons.

One reason is that bombardment of a material by an electron beam also adds heat to the material and raises its temperature. Some materials with suitable K-shell fluorescence have a low melting temperature. Such materials may melt during bombardment by the electron beam. A material with low heat capacity has its temperature rise rapidly to its melting point when it is heated. When the target melts, the x-ray tube becomes unusable.

For example, for bone structure and soft tissue analysis that are objects of the AMPDXA scanning system, a material with a K-shell fluorescence at photon energy below 50 thousand electron volts ("kilo-eV," or, simply, "keV") is desirable. A candidate material is Holmium (symbol Ho, Z=67). However, the melting point of Ho is 1461 degrees Celsius (° C.), well below the melting point of Tungsten at 3422° C.

One solution is to cool the material with a cooling system to prevent melting. However, the effectiveness of a cooling system is limited by the thermal conductivity of the material being cooled. To produce x-rays of a given intensity, the target material has to be bombarded at a certain rate, which produces heat at a certain rate. If the thermal conductivity of the material is too low, the heat cannot be carried away before the temperature of the material rises to the melting point. The target then melts and the x-ray tube is rendered unusable. For example, the thermal conductivity of Holmium is 16.2 Watts per meter per Kelvin (W/m-K), well below the thermal conductivity of Tungsten at 174 W/m-K.

In most cooling systems, a heat-exchange fluid, such as air, is often brought into contact with the target. As used herein, a fluid is any material that does not withstand shear stresses, and includes both gases and liquids. Therefore, the target is placed between the vacuum chamber and the heat-exchange fluid at greater pressures than in the vacuum chamber. The target must be strong enough to withstand this pressure difference. Some candidate K-shell fluorescence materials are not strong enough to withstand such a pressure difference. Even if the target material is strong enough, if the temperature approaches the melting point, the strength of the target may decrease to the point that the target cannot withstand the pressure difference. The target may then fail to maintain the vacuum, and the x-ray tube will again be rendered unusable.

3. X-Ray Tube Target

According to some embodiments of the invention, a target is constructed in which a material with desirable K-shell fluorescence is deposited on a substrate made of a different material with desirable target properties such as a desirable melting point, heat capacity, thermal conductivity, and strength to withstand the vacuum in the vacuum chamber of the x-ray tube.

FIG. 1 is a block diagram that illustrates an x-ray tube 100 with a selectable x-ray frequency, according to an embodiment. The x-ray tube 100 includes an electron beam source 110 and vacuum chamber walls 104 to form a vacuum chamber 102 into which the electron beam 112 can be introduced. According to the illustrated embodiment, a target 130 forms one portion of the vacuum chamber walls 104. The illustrated embodiment also includes an electric field source 120 distinct from the electron beam source 110.

The electron beam source 110 includes a heated cathode supplied with electrons by a high voltage power source. In some embodiments, the electron beam source 110 includes a wire grid anode to accelerate the electrons into an electron beam. In the illustrated embodiment, the anode for the electron beam source 110 is the target 130 distinct from the electron beam source 110. In the illustrated embodiment, the target 130 is oriented substantially perpendicularly to the direction of propagation of the electrons in the electron beam 112. In other embodiments, the target is oriented obliquely, at a angle substantially different from an angle perpendicular to the direction of propagation of the electrons in the electron beam, as described in more detail below.

When the electron beam 112 strikes the target 130, x-rays 190 of a selected frequency band are emitted. In the illustrated embodiment, the x-rays 190 are produced by bremstrahlung and K-shell fluorescence so that a narrow frequency spectrum is produced that is optimal for the application without the use of additional filters. The bremstrahlung radiation emitted above and below the desired frequency band tends to be absorbed within the target, while frequencies within the band are transmitted through it. The K-shell fluorescence depends upon the atomic number of atomic elements, as is well known in the art and a material tends to be relatively transparent to this fluorescence. For example, the target 130 may include the atomic element Holmium with the atomic number 67 so that the K-shell fluorescence produces a narrow spectrum with a peak near a frequency corresponding to 45 keV. One reason for the increased energy efficiency of this embodiment is that the bremstrahlung radiation at energies above the K-shell binding energy tend to be re-emitted as K-shell fluorescence. This wasted energy is discarded in conventional reflection target designs. Thus the useful beam within the desired frequency band consists of K-shell fluorescence resulting from electron collisions in the target, K-shell fluorescence from the absorption of higher energy bremstrahlung in the target and those unabsorbed bremstrahlung radiations emitted within the desired energy band.

FIG. 1 includes a close view of the target 130. As shown in the close view, target 130 includes a substrate 132 upon which selectable deposits 134 have been deposited. In the illustrated embodiment, two selectable deposits 134*a*, 134*b* have been deposited on substrate 132. In other embodiments, more or fewer deposits are deposited on substrate 132. Each deposit includes material, such as one or more atomic elements, that has K-shell fluorescence that is desirable for one or more applications for the x-ray tube 100. For example, for the AMPDXA applications, simulations suggest a low frequency in a range of frequencies that correspond to photon energies from 40 to 45 keV would be optimal and that a high frequency that corresponds to photon energies near 140 keV is desirable. Therefore, in one embodiment, a target for an AMPDXA scanning system x-ray tube includes a deposit 134*a* that has a K-shell fluorescence with a peak frequency that corresponds to a photon energy less than about 50 keV, and includes a deposit 134*b* that has a K-shell fluorescence with a peak frequency that corresponds to a photon energy greater than about 100 keV.

With such deposits, no filters are used, and no mechanism is needed to move one filter into place and another filter out of place. For example, in conventional DXA systems a tungsten target is used which is not transparent for many of the x-ray frequencies produced, so the x-rays are reflected from the target and do not pass through the target. With energy efficiencies of 1% or less, the reflection target produces a broad range of x-ray energies with a maximum corresponding to the electron acceleration voltage. X-rays at the desired energy bands are produced by placing one or more filters in the beam path which transmit the desired frequencies while discarding the rest. Simulations suggest that a frequency corresponding to a photon energy below 50 keV would provide a significant improvement over the conventional x-ray source.

In the illustrated embodiment, the electric field source 120 is used to direct the electron beam 112 to a selected deposit 134*a* of multiple selectable deposits 134. In other embodiments, other methods may be used to direct the electron beam 112 to a selected deposit 134*a*. Directing the electron beam to a selected deposit 134*a* is described in more detail in a later section.

Because the material in a deposit may not be suitable for a target by virtue of its melting point, or thermal conductivity, or strength, or some combination of these properties, it is deposited on a substrate that provides the needed properties. The substrate is preferably transparent to the x-rays produced by the deposit. Atomic elements with low atomic number (Z) are transparent to x-rays. Metals with low atomic numbers have the strength to support a vacuum. For example, the metal Beryllium, with Z=4, is often used as an x-ray transparent window in the walls of a vacuum chamber.

In some embodiments, the deposit is formed as a thin film. For example, a deposit with a low melting point and low thermal conductivity is deposited as a thin film so that the heat generated in the deposit quickly reaches the substrate, where the high thermal conductivity of the substrate can carry the heat more rapidly through the greater thickness needed to withstand the pressure difference between a cooling fluid and the vacuum chamber.

The thickness of the film is designed to optimize absorption of photon energies above the K-shell binding energies, while balancing thermal conductivity to the substrate. The acceleration voltage should thus be substantially above the K-shell binding energy. X-ray photons generated above the K-shell binding energy tend to be absorbed by collisions with K-shell electrons, and thus tend to generate K-shell fluorescence. It is a great advantage of such embodiments that much of the x-ray energy that is self absorbed in the target is re-emitted within the desired energy band below the K-shell ionization energy. The source is thus brighter than a conventional reflection target filter combination where unwanted energies are discarded rather than re-emitted in the desired frequency range.

The deposits may be formed in any manner known in the art. For example, sputtering, a well-known technique, could be used to fabricate one or more thin film deposits on a substrate. During sputtering, a gas of charged particles (a "plasma") knocks atoms of a material from a source of the pure material, such as a foil, rod, or lump, and deposits those atoms on a substrate.

For the AMPDXA applications, a low frequency with photon energies below 50 keV can be produced by atomic elements having atomic numbers in the range from about 64 to about 74. These are mostly in the Lanthanide series of the periodic table and are listed below in Table 1.

TABLE 1

Candidate atomic elements for producing the low x-ray frequency in DXA applications.

| Atomic Number | Element Name | Element Symbol | K-Shell binding energy (keV) | K-shell to L-shell energy (keV) | Melting Point (° C.) |
|---|---|---|---|---|---|
| 64 | Gadolinium | Gd | 50.2 | 42–43 | 1312 |
| 65 | Terbium | Tb | 52.0 | 43–45 | 1356 |
| 66 | Dysprosium | Dy | 53.8 | 45–46 | 1407 |
| 67 | Holmium | Ho | 55.6 | 46–48 | 1461 |
| 68 | Erbium | Er | 57.5 | 48–49 | 1497 |
| 69 | Thallium | Tm | 59.4 | 49–51 | 1545 |
| 70 | Ytterbium | Yb | 61.3 | 51–52 | 824 |
| 71 | Lutetium | Lu | 63.3 | 52–54 | 1663 |
| 72 | Hafnium | Hf | 65.4 | 54–56 | 2231 |
| 73 | Tantalum | Ta | 67.5 | 56–58 | 3020 |
| 74 | Tungsten | W | 69.5 | 57–59 | 3422 |

In one embodiment, the material of choice is Holmium because its L to K shell transition energies are between about 46 to about 48 keV. It has an excellent heat capacity (about 27.2 Joules per °Kelvin per mole) so it reaches its melting point slowly when heated. For reference, Tungsten has a heat capacity of about 24.3 Joules per °Kelvin per mole. Holmium is not typically fabricated into sputtering targets. It is soft, malleable and slowly attacked by oxygen and water. However, nearly pure Holmium (99.9% pure) rods and foils are available for electron beam deposition or other forms of physical vapor deposition. A coating to protect the Holmium deposit may be necessary in some embodiments. It is anticipated that a coating may be omitted in some embodiments because the Holmium is deposited only on the vacuum side of the target where interaction with oxygen and other reagents is essentially absent.

For the AMPDXA applications, a high frequency with photon energies above 100 keV can be produced by atomic elements having atomic numbers in the range from about 87 to about 92. These have K-shell binding energies (rather than K-shell to L-shell transition energies) that exceed 100 keV and are listed below in Table 2. (Radon, Z=88, is a gas and is omitted from Table 2.)

TABLE 2

Candidate atomic elements for producing the high x-ray frequency in DXA applications.

| Atomic Number | Element Name | Element Symbol | K-shell binding energy (keV) | K-shell to L-shell energy (keV) | Melting Point (° C.) |
|---|---|---|---|---|---|
| 87 | Francium | Fr | 101 | 83–86 | 300 |
| 89 | Actinium | Ac | 107 | 87–91 | 1050 |
| 90 | Thorium | Th | 110 | 89–93 | 1842 |
| 91 | Protactinium | Pr | 113 | 92–96 | 1586 |
| 92 | Uranium | U | 116 | 94–98 | 1132 |

In one embodiment, the material of choice is Thorium. Thorium also has an excellent heat capacity (about 27.3 Joules per Kelvin per mole) so it reaches its melting point slowly when heated. It has a relatively high melting point compared to other elements in this list. Thorium is available in many forms and can easily be obtained as a sputtering target or a solid form for electron beam deposition. Purities of currently available Thorium source materials can range up to about 99.5%.

Both Holmium and Thorium have relatively low thermal conductivity, however. The thermal conductivity of Holmium is about 16.2 W/m-K and the thermal conductivity of Thorium is about 54 W/m-K. Tungsten, by way of comparison, has a thermal conductivity of about 174 W/m-K, as stated above. Therefore Holmium and Thorium are both advantageously deposited on a substrate of substantially higher thermal conductivity. Because Beryllium has such a low thermal conductivity (about 8 W/m-K), it is not a favored substrate. Because Tungsten is not transparent to the x-rays produced in these applications, it is not a suitable substrate material in these embodiments.

Candidate substrate materials for target 130 in AMPDXA applications are listed in Table 3.

TABLE 3

Candidate materials for a substrate in AMPDXA applications.

| Atomic Number | Material Name | Thermal conductivity (W/m-K) | Melting Point (° C.) |
|---|---|---|---|
| 4 | Beryllium | 8 | 1287 |
| 6 | Polycrystalline diamond (Carbon) | about 800 to 1000 | 3527 |
| 5, 6 | Sapphire (aluminum oxide) | 29–67 | 2350 |
| 5, 6 | Boron Carbide | 30–90 | 2450 |
| 5, 7 | Pyrolytic Boron Nitride ceramic | 60 | 2500 |
| 13 | Aluminum | 235 | 660 |
| 14 | Silicon | 145 | 1414 |

Multiple deposits may be disposed on the substrate in any manner. In some embodiments, multiple deposits are adjacent in a linear or grid pattern; in some embodiments, multiple deposits are concentric. In some embodiments, the area of the substrate covered by each deposit is determined by the number of x-ray photons to be emitted per unit time (i.e., emission intensity).

In some embodiments, the rate of heating a deposit during bombardment by the electron beam is reduced by spreading the electron beam over an area on the deposit that is greater than the cross sectional area of the electron beam. This is done by orienting the target (such as a substrate and thin deposit) at an oblique angle substantially different from an angle perpendicular to the direction of propagation of the electrons in the electron beam. The area of the deposit struck by electrons is then greater than the cross sectional area of the electron beam. The rate of heat production per unit area is therefore less than in a target that is oriented perpendicular to the electron beam. The rate of x-ray production is the same, because that is determined by the current (electrons per second) in the electron beam.

For the x-ray source to appear as a narrowest possible spot source of x-rays to a subject external to the x-ray source, a line through the deposit and the subject is coaxial with the electron beam, and the target is oriented obliquely to both.

Thus, in some embodiments, the substrate is inclined at a steep angle with respect to the axis of the electron beam. In this embodiment the surface of the target bombarded by the electron beam is enlarged as the sine of the inclination angle. This embodiment spreads the electron beam over a larger surface thus allowing larger beam currents within the thermal limits of the target surface. Since the x-ray emission emerges below, the target surface is effectively foreshortened so that increased thermal load is permitted without sacrificing the loss of image sharpness due to an enlarged emission surface. This line focus principle is well known in the art of conventional x-ray tube manufacture 4. X-Ray Tube Deposit Selection In some conventional systems, a target is made of multiple materials. Which material the electron beam strikes is determined by moving the target with respect to a stationary beam. For example, two different materials are placed at different azimuthal portions of a rotating disc; as the disc rotates the two materials alternately intersect the electron beam to generate x-rays with alternating spectra.

According to some embodiments of the invention, the substrate is moved to alternately place one of the multiple deposits in the path of an electron beam. In some such embodiments, the electron beam is stationary. For example, in some embodiments, different deposits are deposited on different azimuthal portions of a disc shaped substrate; and the substrate is rotated so that the different deposits alternate intersect a stationary electron beam. In other embodiments, different deposits are arrayed in a row or grid of rows and columns on a substrate, and the substrate is incrementally moved horizontally in one or two directions so that a selectable deposit is positioned to intersect a stationary electron beam.

According to some embodiments, the substrate is stationary with respect to the x-ray tube and the electron beam is steered by an electric field that is generated by a source of electric field that is distinct from the electron beam source and is internal or external to the vacuum chamber. In the embodiment illustrated in FIG. 1, the electric field source 120 that directs the electron beam includes plates inside the vacuum chamber 102, which are charged under external control, to deflect the electron beam to strike one deposit or another. For example, with the electric field off, the electron beam 112 strikes deposit 134*a*; and with the electric field on, the electron beam 112 strikes deposit 134*b*. In embodiments with more than two deposits 134 on substrate 132, more than two settings of the electric field are generated by the electric field source 120. An x-ray tube with electric field switching is expected to improve switching time between different deposits. In addition, electric field switching eliminates moving parts to alternately position different portions of the target in the path of the electron beam. This decreases the complexity of the x-ray tube and increases its reliability.

5. X-Ray Source with Cooling System

As a result of the electron beam striking the deposit on the substrate, the deposit and target will heat up. To prevent melting, a cooling system is employed. Many conventional x-ray tubes employ a rotating anode which incorporates the target material on a rotating disk. The disk is inside the vacuum envelope, remote from external surface of the walls of the vacuum chamber, and cannot be cooled directly. Heat generated in the target surface is dissipated into the body of the disk through the rotational bearings, and the heat loss from the disk is mainly due to radiative transfer. The extra heat transferred through the rotational bearings reduces the life of those bearings. The heat radiated to the external surfaces of the walls of the vacuum chamber then is dissipated into the fluid surrounding the walls of the vacuum chamber.

Direct spray cooling is more efficient than air convection cooling, as shown by the data in Table 4 listing ranges of heat transfer coefficients of common cooling techniques in units of Watts per square centimeter per Kelvin ($W/cm^2$-K) in order of increasing efficiency. Considerable efficiencies could be attained if the target could be cooled directly so that heat gain during operation does not exceed the melting point of the target. Therefore, in some embodiments, direct-spray cooling is employed. In the illustrated embodiments, the target is placed directly on the external surface of the walls of the vacuum envelope so that the target is accessible to cooling by a direct spray method. In some embodiments, the material and thickness of the target substrate and the thickness of the target deposits is optimized to produce the maximum x-ray output for a given thermal load from the electron beam The superior performance of spray cooling techniques results in smaller coolers, lower flow rates, lower power consumption by pumps that move the cooling fluids, and heat exchanges that operate at ambient temperatures. As a consequence, the x-ray source with direct-spray cooling can be smaller and lighter than an x-ray source that relies on the other common cooling techniques listed. The x-ray source can also tolerate a larger power loading than a source that is not directly and dynamically cooled.

TABLE 4

Heat transfer coefficients of common cooling techniques.

| Method | Heat transfer coefficient approximate range ($W/cm^2$-K) |
|---|---|
| Air convection | 0.00057 to 0.0027 |
| Air forced convection | 0.0025 to 0.030 |
| Fluorocarbon liquid forced convection | 0.025 to 0.25 |
| Fluorocarbon liquid boiling heat transfer | 0.07 to 0.55 |
| Water forced convection | 0.025 to 1.2 |
| Water boiling heat transfer | 0.25 to 5.7 |
| Fluorocarbon liquid jet impingement | 0.57 to 10 |
| Fluorocarbon spray cooling | 1.1 to 5.5 |
| Water spray cooling | 9 to 27 |

Figure 2A:
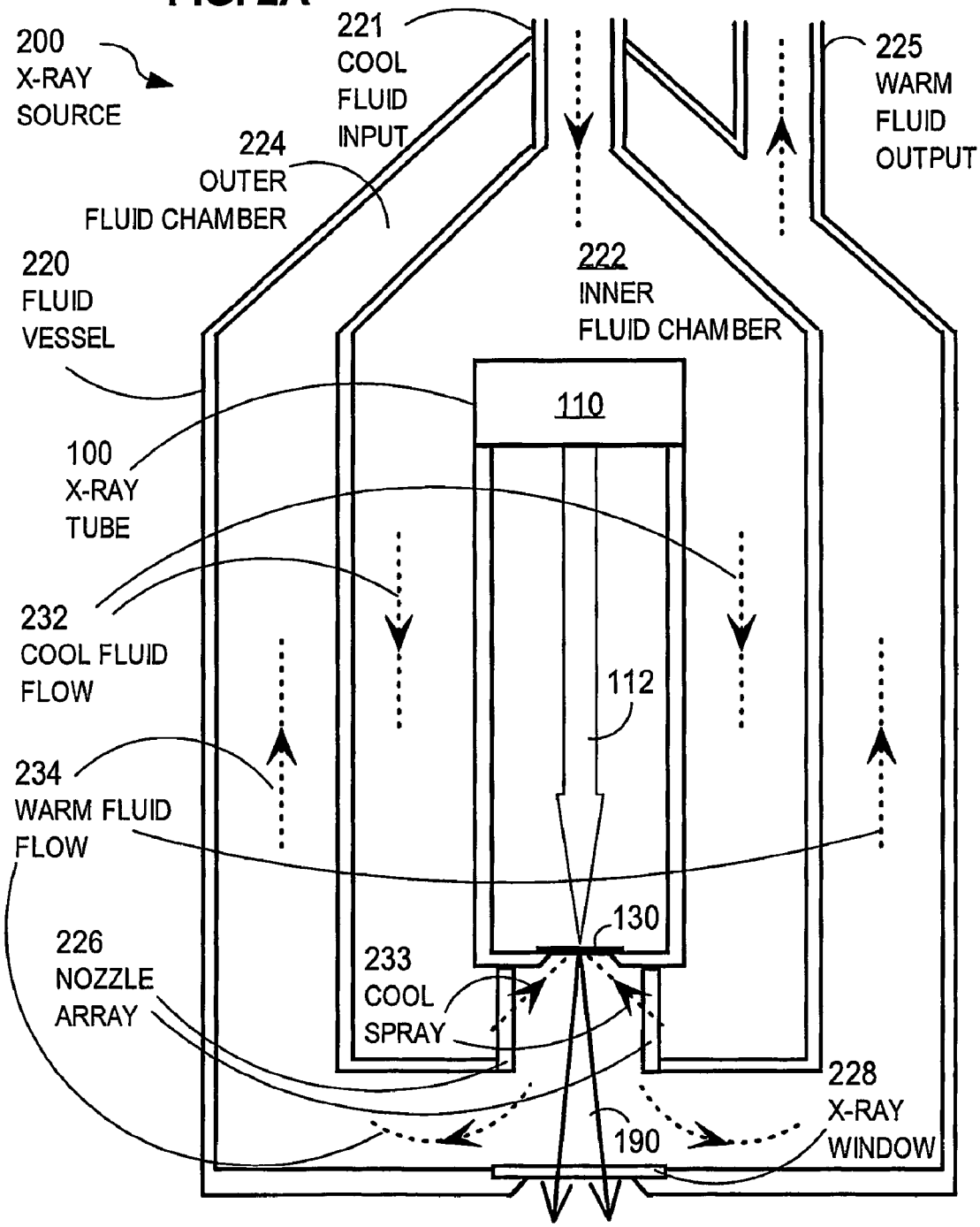
FIG. 2A and FIG. 2B are block diagrams that illustrate an x-ray source with a cooling system that has external cooling components, according to an embodiment.

FIG. 2A is a block diagram that illustrate an x-ray source with a cooling system, according to an embodiment. As shown in FIG. 2A, the x-ray source 200 includes an x-ray tube 100 as depicted in FIG. 1 with an electron beam source 110 that produces an electron beam 112 to strike target 130. In addition, x-ray source 200 includes a fluid vessel 220 that holds a heat-exchange fluid in contact with x-ray tube 100. The fluid vessel 220 includes internal walls that define an inner fluid chamber 222 and an outer fluid chamber 224. A cool fluid input 221 provides direct access to the inner fluid chamber 222. A warm fluid output 225 provides direct access to the outer fluid chamber 224. An x-ray window 228 forms a portion of the outer wall of the fluid vessel 220. The x-ray window 228 is relatively transparent to any frequency band of the selected frequency x-rays 190 produced in the target 130 of the x-ray tube 100.

Separating the inner chamber 222 from the outer chamber 224 is a nozzle array 226 of one or more nozzles. Any type of nozzle may be used in nozzle array 226. In some embodiments, the nozzle array 226 is constructed of an annular plate disposed coaxially with the target. In the plate are formed multiple orifices. Each orifice directs a fluid passing through the orifice toward the target. The rate of cooling provided by a given orifice pattern is determined by the heat exchange fluid being sprayed and the pumping speed. In some embodiments, the density of fluid streams striking the outer surface of the target matches the heat profile on the target, so that more fluid is sprayed on the hotter portions of the target.

Any gas or liquid may be used as the heat-exchange fluid. All of the fluids in Table 4 meet this requirement for the useful x-ray frequencies emitted by the target materials. The fluid should be transparent to the x-rays produced by the x-ray tube 100. In some embodiments, the fluid is a dielectric so that it does not conduct electricity. In some embodiments the target surface will be at ground potential so that conductivity of the cooling fluid will not be an issue. In one embodiment, the fluid is water.

Fluid that is cool compared to the x-ray tube during operation of the x-ray tube is introduced into the inner chamber 222 through cool fluid input 221, and passes around the x-ray tube 100 as indicated by the cool fluid flow arrows 232. For example, liquid water is introduced into the inner chamber 222 through cool fluid input 221. During operation of the x-ray tube, the walls of the x-ray tube 100 may become heated, at least in part due to conduction of heat from the target 130. The heating of the walls raises the temperature of the walls of the x-ray tube above the temperature of the fluid in the cool fluid flow 232. The fluid in the cool fluid flow 232 absorbs heat from the elevated temperature walls of the x-ray tube 100 by convection cooling.

In the illustrated embodiment, the fluid is sprayed onto an outer surface of target 130, outside the vacuum chamber. The fluid is directed to the outer surface of target 130 by the nozzle array 226 as indicated by the cool spray arrows 233. The target is expected to be the hottest part of the x-ray tube 100, and the cool spray 100 cools the target faster than the convection cooling performed by the cool fluid flow 232 would. The cool spray 233 cools the outer surface of the target 130. In one embodiment, each orifices of the nozzle array "atomizes" a liquid phase of the fluid and creates a fine mist of droplets that coats the target with a thin film of liquid.

In the illustrated embodiment, the target is composed of two deposits 134*a*, 134*b* on substrate 132. In other embodiments, the target is a conventional target or a substrate with a single deposit or more than two deposits or deposits of one or more different materials. In the illustrated embodiment, the heat generated in a deposit 134 is transferred to the substrate, where the high thermal conductivity of the substrate carries the heat rapidly to the cool spray 233. As described above, for deposits of materials with low thermal conductivity, the deposit 134 forms a thin film on the substrate 132 so that the heat is rapidly transferred to the substrate with the much higher thermal conductivity. The cool spray 233 cools the outer surface of the substrate 132 of target 130.

The fluid in the cool spray 233 absorbs heat rapidly from the target 130 and carries that heat away in the warm fluid flow indicated by the arrows 234. In some embodiments, the fluid may change phase as it absorbs the heat from the target 130. For example, fluid in the liquid phase forms the cool spray 233, but the fluid changes to its gas phase (also called "vapor") upon absorbing heat at the outer surface of the target 130. For example, the liquid film coating the outer surface of the target from the spray essentially instantly vaporizes to absorb heat during a phase change into vapor. In such embodiments, the warm fluid flow 234 includes fluid in the gas phase. The heat absorbed during phase transition from liquid to gas extracts a quantity of heat without raising the temperature of the fluid, and often increases the efficiency of the heat transfer from target 130 to fluid.

5.1 X-Ray Source with External Cooling System Elements

Figure 2B:
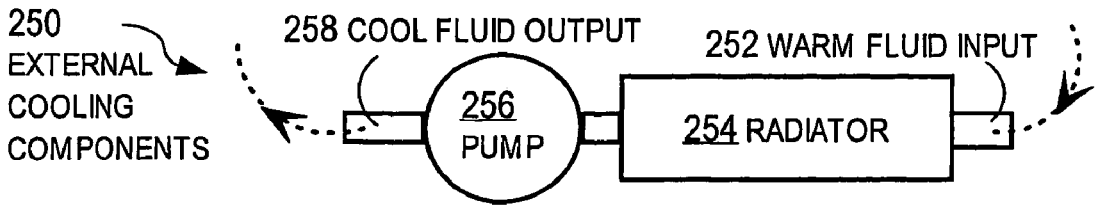

FIG. 2B is a block diagram that illustrates external cooling components 250 of a cooling system for an x-ray source, according to an embodiment. The external components 250 include a warm fluid input 252, a radiator 254, a pump 256, and a cool fluid output 258. The radiator radiates heat into ambient cool temperatures from a warm fluid flowing into the warm fluid input 252. Vapor, in some embodiments with fluid that includes vapor, is condensed back into liquid, liberating heat to the ambient temperature. The ambient cool temperatures may be room temperature where the x-ray source is used or the deep cold of interplanetary space.

The pump 256 forces fluid flow in the direction desired from warm fluid input 252 to cool fluid output 258. In addition, the pump forces fluid through the fluid vessel 220 and through the nozzle array 226. In some embodiments, standard fluid pumps are employed; in embodiments involving phase changes of the heat exchange fluid, electro-kinetic pumps may be employed. In some embodiments, the positions of the radiator 254 and the pump 256 are swapped, so that the warm fluid passes first through the pump and then through the radiator to be cooled. In some embodiments, the pump powers a compressor that compresses the fluid to raise its temperature to more effectively radiate its heat to ambient cool temperatures. In some embodiments more than one pump is used.

The external components 250 are connected to the fluid vessel 220 with tubing (not shown) that is suitable for carrying the fluid without significant leakage between the external components 250 and the fluid vessel 220. Such tubing connects the warm fluid output 225 of fluid vessel 220 to the warm fluid input 252 of the external cooling components 250. Similarly, tubing connects the cool fluid output 258 of external cooling components 250 to the cool fluid input 221 of the fluid vessel 220.

The pump speed is controlled to be sufficient to keep the target or deposits from melting or to keep the x-ray tube from failing due to overheating. In one embodiment, a microcontroller and temperature sensor are utilized to control the pumping speed based on real time, or near-real time, observations of temperature changes in or near the target. In some embodiments, the microcontroller is built into the x-ray source. In other embodiments, the microcontroller is part of an external computer system, as described in more detail below.

5.2 X-Ray Source with Compact Integrated Cooling System

Figure 3:
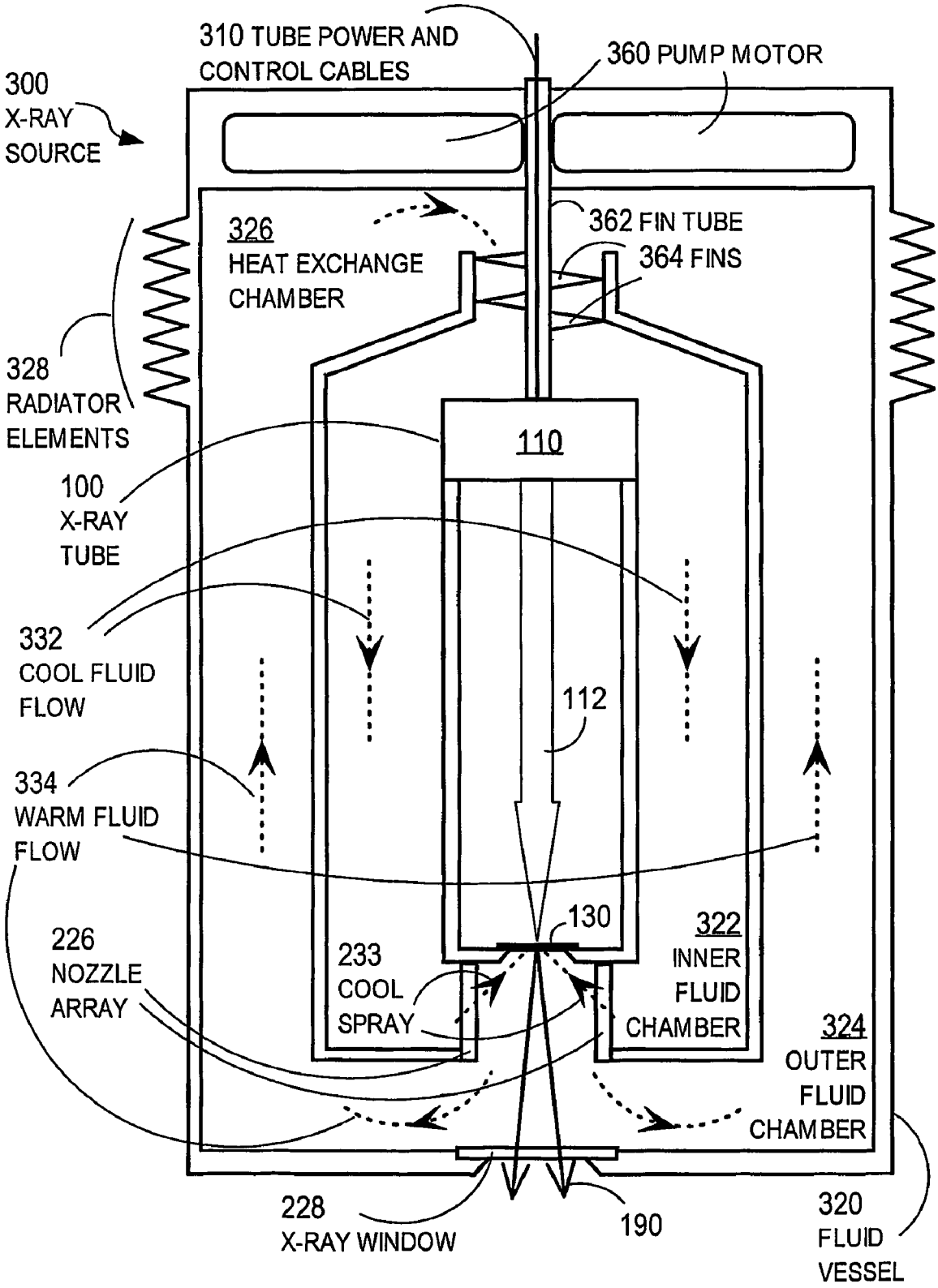
FIG. 3 is a block diagram that illustrates an x-ray source with a compact, integrated cooling system, according to an embodiment.

In some applications, it may be advantageous for the x-ray source to be more compact and self-contained. For example, in space-borne applications of AMPDXA, a compact, self-contained x-ray source without external components and fragile tubing is desirable. FIG. 3 is a block diagram that illustrates an x-ray source 300 with a compact, integrated cooling system, according to an embodiment.

Like the x-ray source 200, the x-ray source 300 includes an x-ray tube 100 with an electron beam source 110 that produces an electron beam 112 to strike target 130. In addition, x-ray source 300 includes a fluid vessel 320 that holds a heat-exchange fluid in contact with x-ray tube 100. The fluid vessel 320 includes internal walls that define an inner fluid chamber 322 and an outer fluid chamber 324. An x-ray window 228 forms a portion of the outer wall of the fluid vessel 320. The x-ray window 228 is relatively transparent to the selected frequency x-rays 190 produced in the target 130 of the x-ray tube 100. Separating the inner chamber 322 from the outer chamber 324 is a nozzle array 226 of one or more nozzles. Any gas or liquid may be used as the heat-exchange fluid. The fluid should be transparent to the x-rays produced by the x-ray tube 100. The fluid should also be a dielectric so that it does not conduct electricity, unless the target is maintained at ground potential as in some embodiments. In one embodiment, the fluid is water. In some embodiments, the spray density is matched to the heat profile of the target 130.

Unlike x-ray source 200, x-ray source 300 does not include a cool fluid input 221 or a warm fluid output 225. Instead, x-ray source 300 uses a closed loop cooling cycle. Fluid that is cool compared to the x-ray tube during operation of the x-ray tube passes around the x-ray tube 100 in the inner chamber 322 as indicated by the cool fluid flow arrows 332. For example, liquid water passes around the x-ray tube 100 in the inner chamber 322 as indicated by the cool fluid flow arrows 332. After passing through the nozzle array 226 into the outer fluid chamber 324, the warm fluid flow 332 carries the warm fluid to a heat exchange chamber 326. The outer walls of the fluid vessel 320 near the heat exchange chamber 326 include radiator elements 328.

An integrated pump forces the fluid from the heat exchange chamber 326 back into the inner fluid chamber 322. According to the illustrated embodiment, the integrated pump includes a pump motor 360 implanted in a wall of the fluid vessel 320, a hollow fin tube 362 rotated by the pump motor, and fins 364 attached to the fin tube 362. The integrated pump is described in more detail below. In some embodiments, standard fluid pumps are employed; in embodiments involving phase changes of the heat exchange fluid, electro-kinetic pumps may be employed.

As in x-ray source 200, in x-ray source 300, the fluid is directed to the outer surface of target 130 by the nozzle array 226 as indicated by the cool spray arrows 233. In the illustrated embodiment, the target is composed of two deposits 134*a*, 134*b* on substrate 132. In other embodiments, the target is a conventional target or a substrate with a single deposit or more than two deposits or deposits of one or more different materials During operation of the x-ray tube, the walls of the x-ray tube 100 may become heated, at least in part due to conduction of heat from the target 130. The heating of the walls raises the temperature of the walls of the x-ray tube above the temperature of the fluid in the cool fluid flow 232. The fluid in the cool fluid flow 332 absorbs heat from the elevated 5temperature walls of the x-ray tube 100 by convection cooling.

The fluid in the cool spray 233 absorbs heat rapidly from the target 130 and carries that heat away in the warm fluid flow indicated by the arrows 234. In some embodiments, the fluid may change phase as it absorbs the heat from the target 130. In such embodiments, the warm fluid flow 234 includes fluid in the gas phase. The warm fluid flow 332 carries the heated fluid to the heat exchange chamber 326 where heat is radiated to ambient temperatures using fluid forced convection and the extra surface area provided by radiator elements 328. The warm fluid is cooled in the heat exchange chamber 328. Vapor, in embodiments with fluid that includes vapor, is condensed back into liquid, liberating heat to the ambient temperature.

The integrated pump forces the cooled fluid from the heat exchange chamber 326 into the inner fluid chamber and through the nozzle array 226. In the illustrated embodiment, the pump motor rotates the fin tube 362 and the attached fins 364 to force fluid from the heat exchange chamber 326 into the inner fluid chamber and through the nozzle array 226. The fin tube 362 is hollow to allow a power cable 310 to pass from outside the x-ray source to the electron beam source 110. In some embodiments, the same or separate cable is used for control of the x-ray tube 100, such as control of power for the electron beam source 110 or control of electric field source 120 to electronically switch the electron beam to a selected deposit, or to move a deposit into the path of the electron beam. In some embodiments, an external computer is used to control the electron beam source 110, or the electric field source 120, or both. In embodiments with a separate cable, the separate cable also passes through fin tube 362. Power and control for the pump motor may be supplied through a separate cable, not shown, that does not pass through the fin tube 264.

In the illustrated embodiment, the pump motor, the fin tube, and the fluid vessel are all coaxial with the x-ray tube 100 and axially symmetric to promote uniform cooling and stresses on the x-ray tube 100. Uniform cooling is believed to lead to more reliable x-ray tube performance. In other embodiments, other arrangement may be used. For example, in embodiments with asymmetric heating of x-ray tube components or targets oblique to the electron beam, asymmetric cooling of tube walls or target or both may be desirable.

The pump speed is controlled to be sufficient to keep the deposits from melting or the x-ray tube from overheating. In one embodiment, a temperature sensor and an internal or external microcontroller are utilized to control the pumping speed based on real time, or near-real time, observations or computations of temperature changes.

6. Method of Operating an X-Ray Source

Figure 4:
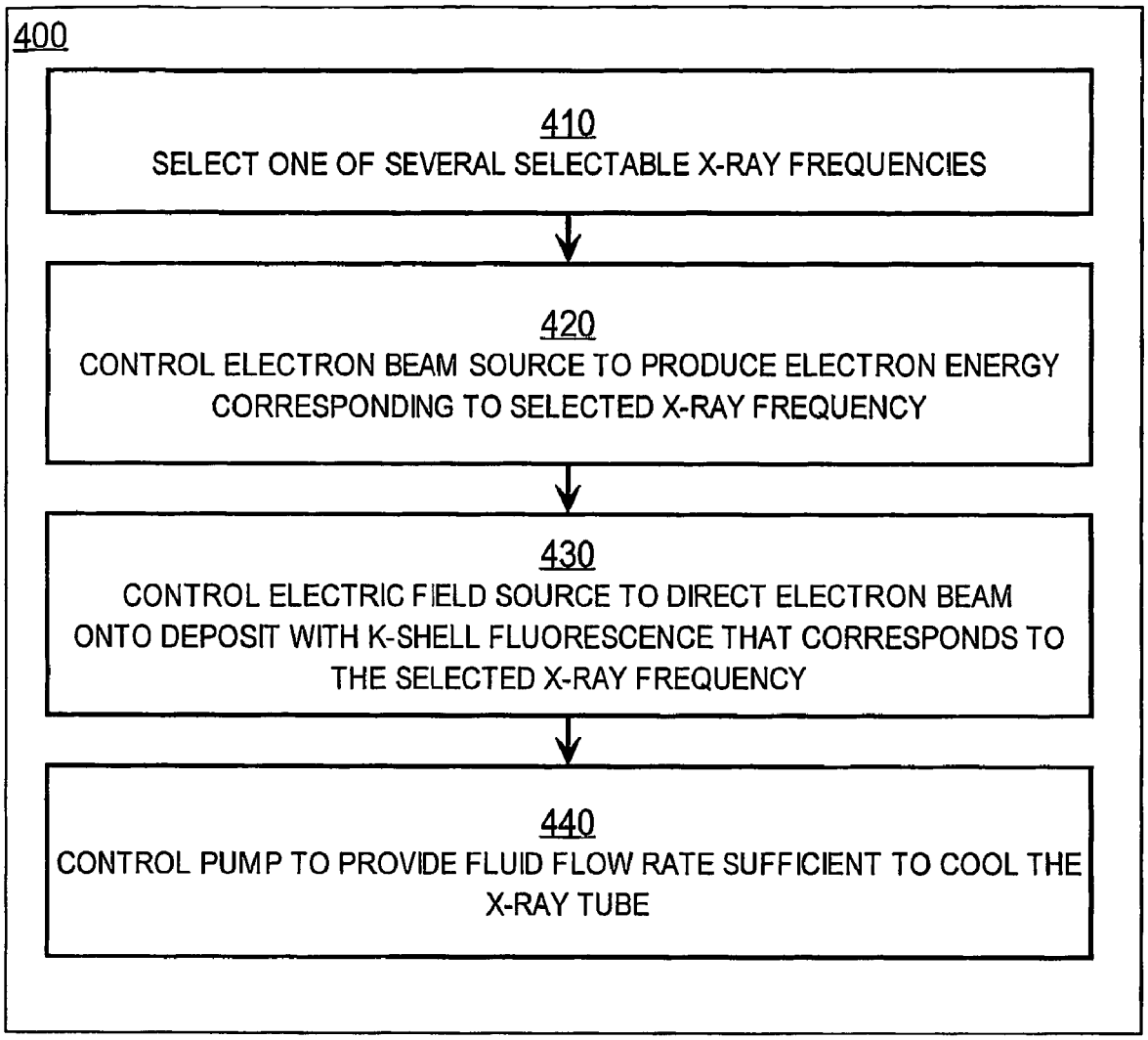
FIG. 4 is a flow diagram that illustrates a method for operating an x-ray source, according to an embodiment.

FIG. 4 is a flow diagram that illustrates a method 400 for operating an x-ray source, according to an embodiment. Although steps are shown in FIG. 4 in a particular order, in other embodiments the steps may be performed in a different order or overlapping in time.

In step 410, one of several selectable x-ray frequency bands is selected. For example, a user manually selects an x-ray frequency band to use among a plurality of x-ray frequency bands that are efficiently produced by an x-ray source. In an AMPDXA scanning system, a computer program determines one of the dual energy x-rays to use for scanning, and determines an exposure time. For example, the computer program determines to use for 2 milliseconds the x-ray frequency band that corresponds to an average energy of 45 keV.

In step 420, the electron beam source of an x-ray source is controlled to produce an electron beam with electron energies appropriate for the selected target. For example, the computer program controls the electron beam source 110 of x-ray source 300 to produce a beam of electrons at an energy substantially above 45 keV, for example at 100 keV.

In step 430, the electric field source is controlled to direct the electron beam onto a deposit with a K-shell fluorescence that corresponds to the selected x-ray frequency band. For example, the electric field source 120 is turned off so that the electron beam 112 strikes deposit 134*a* that includes Holmium in x-ray source 300. The electron beam energy will produce x-rays by K-shell fluorescence within the desired frequency band but also by bremstrahlung constituting a broad range of frequencies up to a maximum determined by the electron beam energy. In the example embodiment, the selected target deposit has a thickness optimized to absorb most of the bremstrahlung emissions outside the useful frequency band and that are directed along the useful beam path. Much of the absorbed bremstrahlung with energies above the K-shell binding energy of the target will be re-emitted as K-shell fluorescence thus further contributing to the useful beam.

In step 440, the pump is controlled to provide fluid flow at a rate sufficient to cool the x-ray tube. For purposes of illustration, it is assumed that the heat exchange fluid is liquid water. It is further assumed, for purposes of illustration, that a computer program computes the heat generated by a 2-millisecond exposure of the Holmium deposit to an electron beam of 100 keV electrons and determines a fluid flow rate to remove some or all of this heat by spray cooling the target 130 with water. The computer program then controls pump motor 360 of the integrated pump to form a cool spray 233 at the proper rate.

7. Computer Overview

Figure 5:
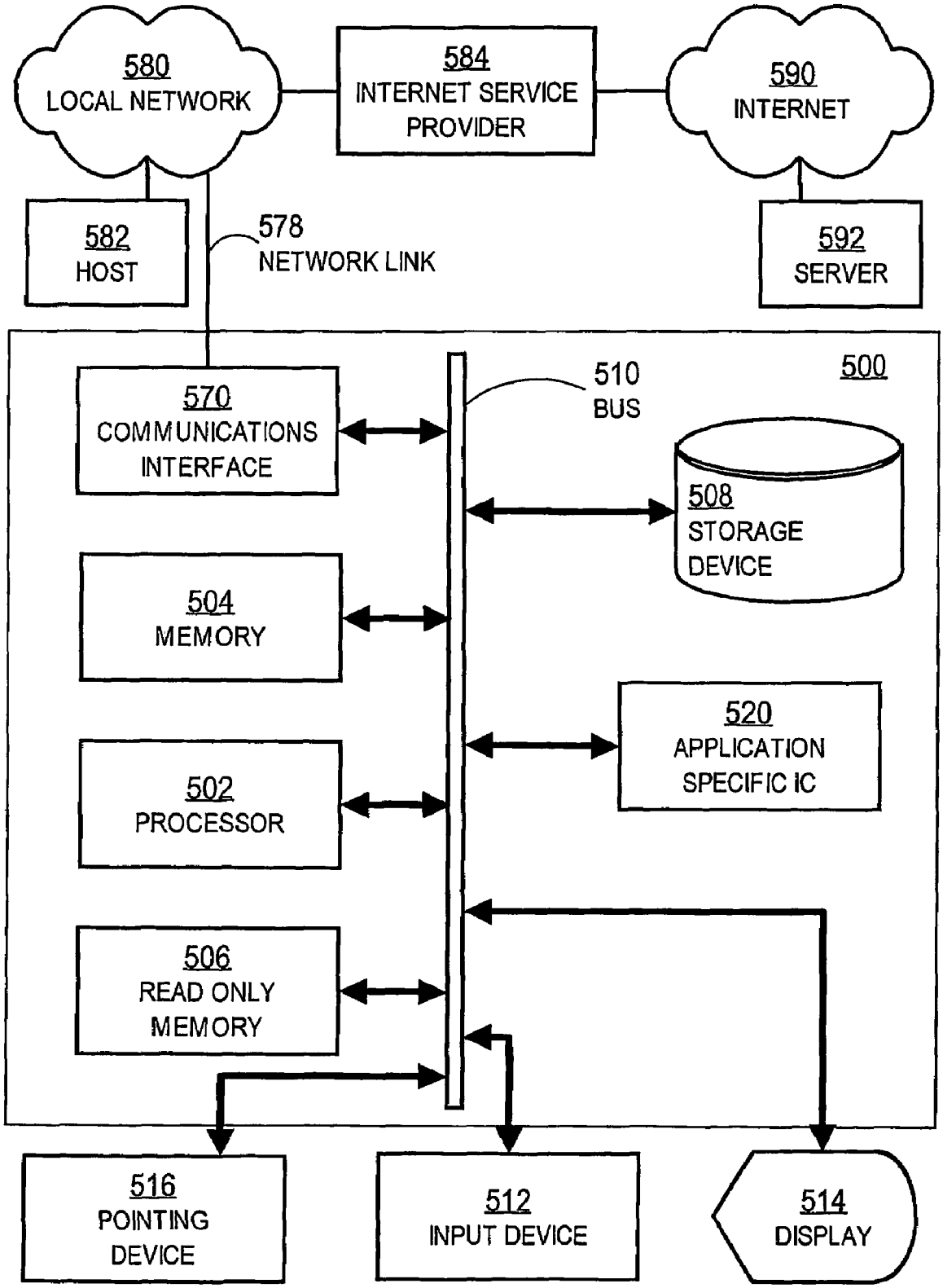
FIG. 5 is a block diagram that illustrates a computer system upon which an embodiment of the method of FIG. 4 may be implemented

FIG. 5 is a block diagram that illustrates a computer system 500 upon which an embodiment of the invention may be implemented. Computer system 500 includes a communication mechanism such as a bus 510 for passing information between other internal and external components of the computer system 500. Information is represented as physical signals of a measurable phenomenon, typically electric voltages, but including, in other embodiments, such phenomena as magnetic, electromagnetic, pressure, chemical, molecular and atomic interactions. For example, north and south magnetic fields, or a zero and non-zero electric voltage, represent two states (0, 1) of a binary digit (bit). A sequence of binary digits constitutes digital data that is used to represent a number or code for a character. A bus 510 includes many parallel conductors of information so that information is transferred quickly among devices coupled to the bus 510. One or more processors 502 for processing information are coupled with the bus 510. A processor 502 performs a set of operations on information. The set of operations include bringing information in from the bus 510 and placing information on the bus 510. The set of operations also typically include comparing two or more units of information, shifting positions of units of information, and combining two or more units of information, such as by addition or multiplication. A sequence of operations to be executed by the processor 502 constitute computer instructions.

Computer system 500 also includes a memory 504 coupled to bus 510. The memory 504, such as a random access memory (RAM) or other dynamic storage device, stores information including computer instructions. Dynamic memory allows information stored therein to be changed by the computer system 500. RAM allows a unit of information stored at a location called a memory address to be stored and retrieved independently of information at neighboring addresses. The memory 504 is also used by the processor 502 to store temporary values during execution of computer instructions. The computer system 500 also includes a read only memory (ROM) 506 or other static storage device coupled to the bus 510 for storing static information, including instructions, that is not changed by the computer system 500. Also coupled to bus 510 is a non-volatile (persistent) storage device 508, such as a magnetic disk or optical disk, for storing information, including instructions, that persists even when the computer system 500 is turned off or otherwise loses power.

Information, including instructions, is provided to the bus 510 for use by the processor from an external input device 512, such as a keyboard containing alphanumeric keys operated by a human user, or a sensor. A sensor detects conditions in its vicinity and transforms those detections into signals compatible with the signals used to represent information in computer system 500. Other external devices coupled to bus 510, used primarily for interacting with humans, include a display device 514, such as a cathode ray tube (CRT) or a liquid crystal display (LCD), for presenting images, and a pointing device 516, such as a mouse or a trackball or cursor direction keys, for controlling a position of a small cursor image presented on the display 514 and issuing commands associated with graphical elements presented on the display 514.

In the illustrated embodiment, special purpose hardware, such as an application specific integrated circuit (IC) 520, is coupled to bus 510. The special purpose hardware is configured to perform operations not performed by processor 502 quickly enough for special purposes. Examples of application specific ICs include graphics accelerator cards for generating images for display 514, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 500 also includes one or more instances of a communications interface 570 coupled to bus 510. Communication interface 570 provides a two-way communication coupling to a variety of external devices that operate with their own processors, such as printers, scanners and external disks. In general the coupling is with a network link 578 that is connected to a local network 580 to which a variety of external devices with their own processors are connected. For example, communication interface 570 may be a parallel port or a serial port or a universal serial bus (USB) port on a personal computer. In some embodiments, communications interface 570 is an integrated services digital network (ISDN) card or a digital subscriber line (DSL) card or a telephone modem that provides an information communication connection to a corresponding type of telephone line. In some embodiments, a communication interface 570 is a cable modem that converts signals on bus 510 into signals for a communication connection over a coaxial cable or into optical signals for a communication connection over a fiber optic cable. As another example, communications interface 570 may be a local area network (LAN) card to provide a data communication connection to a compatible LAN, such as Ethernet. Wireless links may also be implemented. For wireless links, the communications interface 570 sends and receives electrical, acoustic or electromagnetic signals, including infrared and optical signals, that carry information streams, such as digital data. Such signals are examples of carrier waves.

The term computer-readable medium is used herein to refer to any medium that participates in providing instructions to processor 502 for execution. Such a medium may take many forms, including, but not limited to, non-volatile media, volatile media and transmission media. Non-volatile media include, for example, optical or magnetic disks, such as storage device 508. Volatile media include, for example, dynamic memory 504. Transmission media include, for example, coaxial cables, copper wire, fiber optic cables, and waves that travel through space without wires or cables, such as acoustic waves and electromagnetic waves, including radio, optical and infrared waves. Signals that are transmitted over transmission media are herein called carrier waves.

Common forms of computer-readable media include, for example, a floppy disk, a flexible disk, a hard disk, a magnetic tape, or any other magnetic medium, a compact disk ROM (CD-ROM), or any other optical medium, punch cards, paper tape, or any other physical medium with patterns of holes, a RAM, a programmable ROM (PROM), an erasable PROM (EPROM), a FLASH-EPROM, or any other memory chip or cartridge, a carrier wave, or any other medium from which a computer can read.

Network link 578 typically provides information communication through one or more networks to other devices that use or process the information. For example, network link 578 may provide a connection through local network 580 to a host computer 582 or to equipment 584 operated by an Internet Service Provider (ISP). ISP equipment 584 in turn provides data communication services through the public, world-wide packet-switching communication network of networks now commonly referred to as the Internet 590. A computer called a server 592 connected to the Internet provides a service in response to information received over the Internet. For example, server 592 provides information representing video data for presentation at display 514.

The invention is related to the use of computer system 500 for implementing the techniques described herein. According to one embodiment of the invention, those techniques are performed by computer system 500 in response to processor 502 executing one or more sequences of one or more instructions contained in memory 504. Such instructions, also called software and program code, may be read into memory 504 from another computer-readable medium such as storage device 508. Execution of the sequences of instructions contained in memory 504 causes processor 502 to perform the method steps described herein. In alternative embodiments, hardware, such as application specific integrated circuit 520, may be used in place of or in combination with software to implement the invention. Thus, embodiments of the invention are not limited to any specific combination of hardware and software.

The signals transmitted over network link 578 and other networks through communications interface 570, which carry information to and from computer system 500, are exemplary forms of carrier waves. Computer system 500 can send and receive information, including program code, through the networks 580, 590 among others, through network link 578 and communications interface 570. In an example using the Internet 590, a server 592 transmits program code for a particular application, requested by a message sent from computer 500, through Internet 590, ISP equipment 584, local network 580 and communications interface 570. The received code may be executed by processor 502 as it is received, or may be stored in storage device 508 or other non-volatile storage for later execution, or both. In this manner, computer system 500 may obtain application program code in the form of a carrier wave.

Various forms of computer readable media may be involved in carrying one or more sequence of instructions or data or both to processor 502 for execution. For example, instructions and data may initially be carried on a magnetic disk of a remote computer such as host 582. The remote computer loads the instructions and data into its dynamic memory and sends the instructions and data over a telephone line using a modem. A modem local to the computer system 500 receives the instructions and data on a telephone line and uses an infra-red transmitter to convert the instructions and data to an infra-red signal, a carrier wave serving as the network link 578. An infrared detector serving as communications interface 570 receives the instructions and data carried in the infrared signal and places information representing the instructions and data onto bus 510. Bus 510 carries the information to memory 504 from which processor 502 retrieves and executes the instructions using some of the data sent with the instructions. The instructions and data received in memory 504 may optionally be stored on storage device 508, either before or after execution by the processor 502.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An x-ray source comprising:

an x-ray tube; and a cooling system comprising:

a fluid vessel for containing a heat-exchange fluid outside the x-ray tube; the fluid vessel including a spray nozzle that directs the heat-exchange fluid to an outside face of a target of the x-ray tube for absorbing heat generated within the target, wherein the fluid vessel further includes a heat exchanger portion of the fluid vessel for directing heat from the heat-exchange fluid inside the fluid vessel to an ambient fluid outside the fluid vessel; and a pump for forcing the heat-exchange fluid through the spray nozzle, wherein fins rotated by the pump are disposed outside a fin tube.

2. The x-ray source of claim 1, wherein an electric motor for the pump and the fin tube rotated by the pump are coaxial.

3. The x-ray source of claim 1, wherein a power cable for the x-ray tube is passed inside the fin tube.

* * * * *